US005282367A

United States Patent [19]

Moore et al.

[11] Patent Number: 5,282,367

[45] Date of Patent: Feb. 1, 1994

[54] REFRIGERATED FOOD PREPARATION TABLE AND METHOD

[75] Inventors: Earl Moore, Blanchard; Thomas Frick, Rosebush; Wayne Smith, Mt. Pleasant; James Lyon, Alma, all of Mich.

[73] Assignee: The Delfield Company, Mt. Pleasant, Mich.

[21] Appl. No.: 872,813

[22] Filed: Apr. 24, 1992

[51] Int. Cl.[5] ..... A47F 3/04

[52] U.S. Cl. ..... 62/256; 62/417; 454/193; 454/284

[58] Field of Search ..... 62/258, 256, 417; 165/100; 454/193, 284, 365

[56] References Cited

U.S. PATENT DOCUMENTS

| | | | |
|---|---|---|---|
| 1,711,691 | 5/1929 | Richter | 62/255 |
| 1,716,366 | 6/1929 | Bond | 62/255 |
| 2,201,265 | 5/1940 | Hill | 62/255 |
| 2,209,690 | 7/1940 | Fraser | 62/89.6 |
| 2,346,368 | 4/1944 | Edwards | 88/74 |
| 2,428,243 | 9/1947 | Raskin | 62/89.5 |
| 2,794,325 | 6/1957 | Shearer | 62/89.5 |
| 3,229,475 | 1/1966 | Balk et al. | 62/256 |
| 3,256,799 | 6/1966 | Beckwith et al. | 62/256 X |
| 3,291,027 | 12/1966 | Beckwith | 454/193 X |
| 3,501,925 | 3/1970 | Brennan et al. | 62/256 |
| 4,329,852 | 5/1982 | Ibrahim et al. | 62/256 |
| 4,592,209 | 6/1986 | Casanova et al. | 62/255 |
| 4,633,677 | 1/1987 | Maehara | 62/256 |
| 4,644,758 | 2/1987 | Maehara et al. | 62/234 |
| 4,685,311 | 8/1987 | Rastelli | 62/258 |
| 4,691,527 | 9/1987 | Ikeda | 62/234 |
| 4,723,414 | 2/1988 | Hurutachi et al. | 62/155 |
| 4,741,171 | 5/1988 | Toshiyaki | 62/234 |
| 4,802,340 | 2/1989 | Johnson | 62/229 |
| 4,977,823 | 12/1990 | Kuwahara | 99/355 |

FOREIGN PATENT DOCUMENTS

| | | | |
|---|---|---|---|
| 3029903 | 4/1981 | Fed. Rep. of Germany | 62/256 |

*Primary Examiner*—William E. Tapolcai

*Attorney, Agent, or Firm*—Harness, Dickey & Pierce

[57] ABSTRACT

A refrigerated food preparation table having an evaporator cooling coil and heat transfer fins which are baffled to create two air flows which are cooled to different temperatures. One air flow passes through a laminar air screen and across an open top of a food container, and the other f low passes along the outer surfaces of the food container, thereby cooling the food container and a volume defined therein. This configuration preferably cools the entire volume within the food container to a temperature below 40' F., yet remaining above 32' F. The laminar air screen may be disassembled and separated for the purpose of cleaning.

37 Claims, 2 Drawing Sheets

REFRIGERATED FOOD PREPARATION TABLE AND METHOD

BACKGROUND AND SUMMARY OF THE INVENTION

This invention relates generally to refrigerated containers, and more particularly to a unique forced air convection refrigerated container.

Refrigerated food preparation tables generally include a food container which has an open top exposed to ambient air for ease of access. Various refrigeration systems for the containers exist, including surrounding the container with refrigeration tubes, passing cooled air along the outer surface of the container, and passing cooled air across the open top of the container. It is desirable to maintain the entire volume of the container at temperatures equal to or below 40° F., and also at temperatures above 32° F. to prevent the food from freezing. However, with a number of the above methods, maintaining the top temperature below 40° F. causes the bottom region of the container to reach temperatures below 32° F., which in turn causes the food in the bottom region to freeze.

The present invention surmounts this problem by providing a novel apparatus and method for cooling the upper and lower regions of the food container at different heat transfer rates. The upper region of the container is cooled by laminar flow forced air convection across the open top of the container with a first air flow which is cooled to a first temperature. The lower region of the container is cooled by forced air convection along the outer surface of the container with a second air flow which is cooled to a second temperature. The apparatus is designed so that the ambient temperature is greater than the second temperature, and the second temperature is greater than the first temperature. The dual temperature air flows are generated in a unique way utilizing a single heat exchanger by forcing the first air flow to follow a more tortuous path through the heat exchanger than the second air flow.

It is therefore an object of the present invention to provide a unique food refrigeration system utilizing forced air convection with a plurality of air flows which are cooled to different temperatures, whereby the aforementioned problems encountered with known systems are overcome.

It is a further object of the present invention to provide a novel refrigeration coil and fin arrangement, whereby one refrigeration heat transfer device cools a plurality of air flows to different temperatures.

It is a further object of the present invention to provide a novel laminar flow air screen which may be easily disassembled for the purpose of cleaning.

These and other advantages and features will become apparent from the following description and claims in conjunction with the accompanying drawings.

DETAILED DESCRIPTION OF THE PREFERRED EMBODIMENTS

Figure 1:
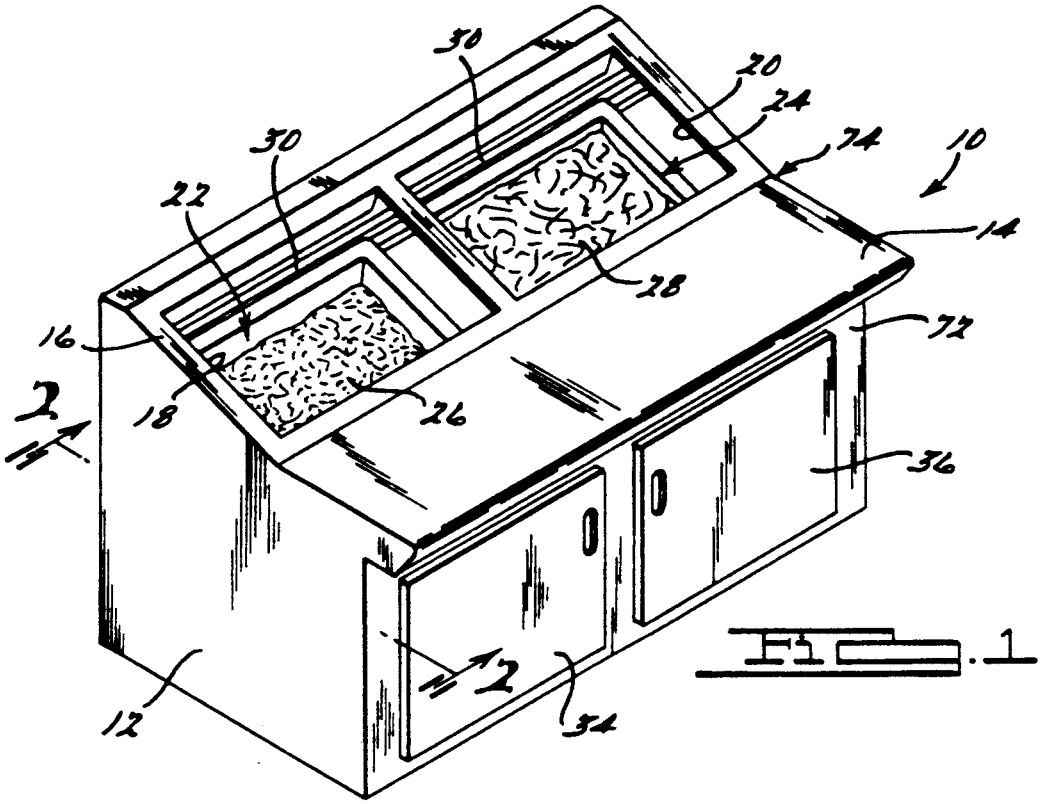
FIG. 1 is a perspective view of a refrigerated food preparation table embodying the principles of the present invention.
Figures 2, 4:
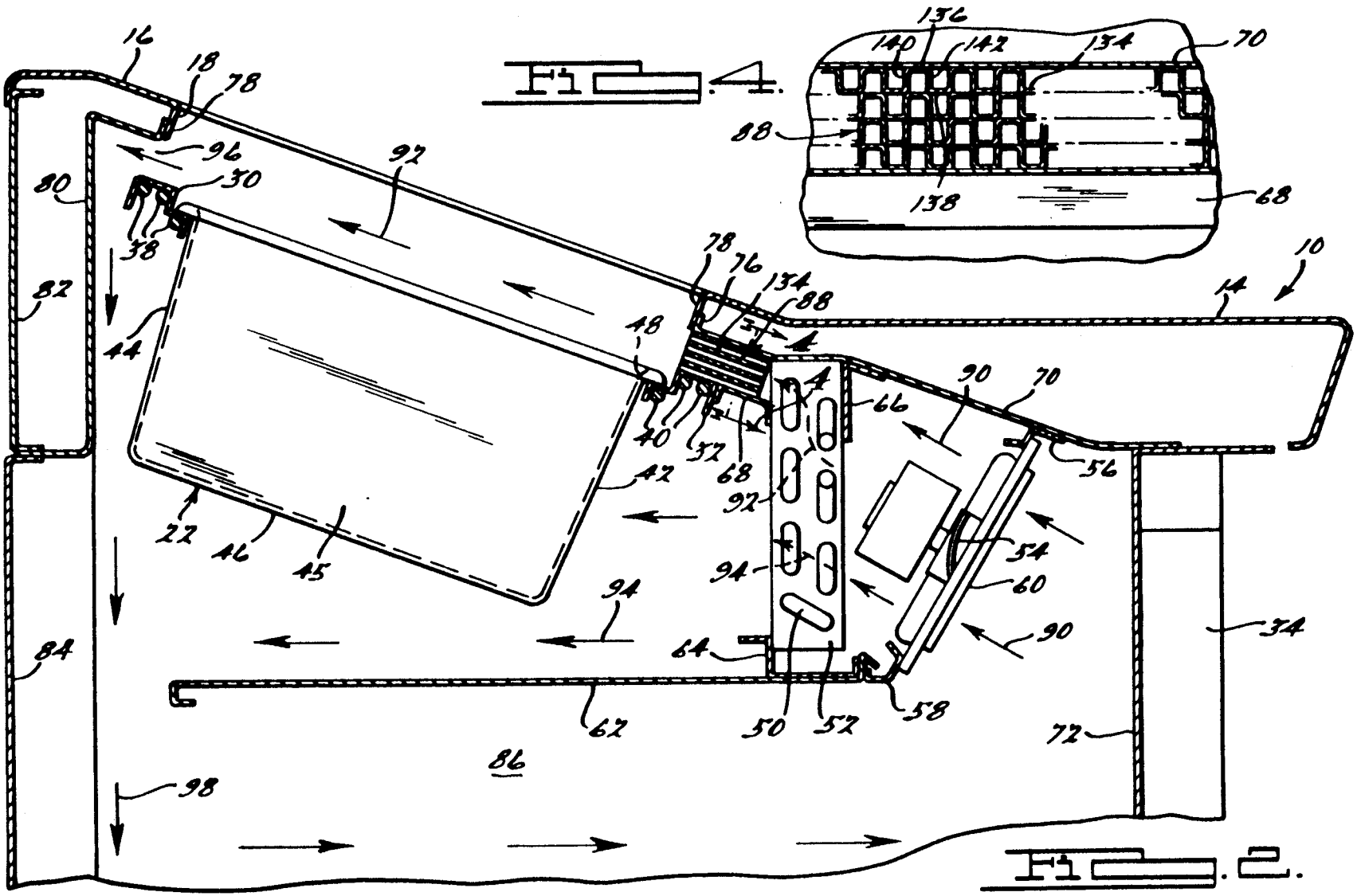
FIG. 2 is a vertical transverse cross-sectional view of a refrigerated food preparation table according to the present invention taken generally along lines 2—2 in FIG. 1.
FIG. 4 is a partial cross-sectional view along line 4—4 in FIG. 2.

With reference to the drawings, FIGS. 1 and 2 show a refrigerated food preparation table 10 constructed of an outer shell 12 and having a horizontal working food preparation surface 14, an inclined food container surface 16 which is formed with preferably two openings 18, 20. Two or more food containers 22 and 24 for containing foods 26, 28 are supported below openings 18 and 20 by rails 30 and 32 which are supported by support bars 38 and 40, respectively. Food container 22 may have any of a variety of shapes and sizes, but is preferably formed with a front sidewall 42, a rear sidewall 44, end side walls 45 and a bottom 46. Food container 22 is preferably shaped as a pan and has an opening 48 at its top. Refrigerated preparation table 10 has preferably two doors 34 and 36 located on the front of the preparation table 10 below the working surface 14. Doors 34 and 36 open and provide access to a refrigerated storage volume in the usual manner.

Food container 22 is cooled by a refrigeration system which includes an evaporator coil 50, heat transfer fins 52, and a fan 54. Fan 54 is supported by upper and lower fan mounts 56, 58 and is shielded by a fan screen 60. A lower air deflector 62 extends horizontally from lower fan mount 58 for approximately the horizontal extent of food container 22. Lower air deflector 62 supports a lower baffle 64 to prevent air flow bypassing the coil 50 and fins 52.

In accordance with the present invention, an airflow generated by fan 52 is split into two primary f lows which are cooled by evaporator coil 50 and fins 52 to two different temperatures by directing one primary flow through a longer, more tortuous flow path through coil 50 and fins 52 than the other flow. This novel method for cooling air flows to two different temperatures with a single heat exchanger having but one coil 50 and a number of fins 52 is accomplished by placing a front baffle 66 across the upper portion of the heat transfer fins 52 on the side facing fan 54 and locating a rear baffle 68 opposite front baffle 66 to direct flow toward the top of the food containers 22 and 24. This preferred method enables a single conventional coil 50, which is uniformly distributed throughout the cross-sectional area of the heat exchanger, to generate two f lows having different temperatures. Another possible method is to concentrate a greater cross-sectional density of coils 50 in the upper portion of fins 52, and force inlet air straight through the entire heat exchanger, thus generating air flows at different temperatures.

Front baffle 66 and upper fan mount 56 are affixed to a top mounting plate 70 which extends from front wall 72 to opening 18. Top mounting plate 70 is affixed to and helps support working surface 14. The rear wall of refrigerated preparation table 10 is formed with a rear inner wall 80, an upper rear outer wall 82 (thereby providing an insulating section), and a lower rear outer wall 84. A return air flow path 86 is defined by front wall 72, lower air deflector 62, and lower rear outer wall 84.

A laminar flow air screen 88 is located in a flow path defined between rear baffle 68 and rail 32, and top mounting plate 70. Laminar air screen 88 is shown more clearly in FIG. 4 and is constructed of a series of f low elements formed as corrugated plates 134 having a series of upper and lower base portions 136 and 138 each connected by sidewalls 140 and 142. Air screen 88 is assembled by placing each plate 134 on top of another, such that each upper and lower base portion 136 and 138 is aligned over a similar upper and lower base portion 136 and 138 respectively. Each plate 134 lies on top of another plate 134 without nesting because the side walls 140 and 142 on one plate 134 overlap similar side walls on the neighboring plates 134. When air screen 88 is in place between baffle 68 and rail 32, and top mounting plate 70, fins 52 act as a stop surface to retain plates 134.

Air screen 88 is preferably constructed such that it may easily slide out of the f low path defined between rear baffle 68 and rail 32 and top mounting plate 70 and removed through opening 18. After air screen 88 is removed, the individual plates 134 may be easily separated for cleaning by hand or in a conventional dishwasher. Plates 134 should be removable for cleaning especially because food in containers 22 and 24 may be spilled into air screen 88. When food is spilled, air screen 88 prevents the food from reaching coil 50 and fins 52.

In operation, fan 54 takes return air from path 86 and creates an inlet air flow 90 which flows through evaporator coil 50 and heat transfer fins 52. Front baffle 66 and rear baffle 68 are operative to separate inlet air flow 90 into a first flow 92 and a second flow 94. Second flow 94 passes directly through evaporator coil 50 and heat transfer fins 52 and is thereby cooled, preferably to a temperature of approximately 34° F. Second flow 94 then passes along the outer front, bottom and side surfaces of food containers 22 and 24 to keep the contained food refrigerated to a greater-than-freezing temperature. Because of baffles 66 and 68, first flow 92 passes through evaporator coil 50 and heat transfer fins 52 in a more tortuous flow path than that followed by second flow 94. As a result, first air flow 92 contacts a greater surface area of evaporator coil 50 and heat transfer fins 52 and is thereby cooled to a lower temperature than second flow 94, preferably to a temperature of approximately 31° F. First flow 92 then passes through laminar air screen 88 which induces less turbulent air flow, especially under steady flow conditions. First flow 92 then passes across opening 48 of the food containers to create a cold air barrier between the volume of food in the food containers and ambient air. First f low 92 then re-enters refrigerated preparation table 10 through a re-entry passage 96, and flows along rear inner wall 80 and along rear sides 44 of food containers 22 and 24, thus further cooling the food containers and the food disposed therein. First and second flows 92 and 94 are then re-combined in the region between lower air deflector 62 and lower rear outer wall 84, to form return air flow 98, which serves to refrigerate the interior storage volume 86 of the enclosed table where other food items and containers may be stored.

It has been discovered that improved performance is achieved if front baffle 66 is formed with a horizontal row of relatively small holes 67 which allow a portion of an inlet air flow 90 to leak directly through front baffle 66, fins 52, coil 50, and eventually combine with first primary air flow 92. Holes 67 are preferably located immediately adjacent to a horizontal tube of coil 50, as shown in FIG. 2. Although it is not fully understood, it is believed that this performance increase results from an improved flow of primary air 92 caused by the leakage flow through holes 67.

Ambient air can be at a temperature as high as 100° F. This ambient air heats the laminar air flow 92 passing over opening 48 at the top of the food containers 22 and 24 preferably to an average air temperature of approximately 34° F. at the center of opening 48 and approximately 38° F. at the re-entry passage 96. As can be seen, at no time is any portion of the food exposed to less than 32° F. or greater than 38° F., thus keeping it in the desired temperature range of between 32° F. and 40° F.

Figure 3:
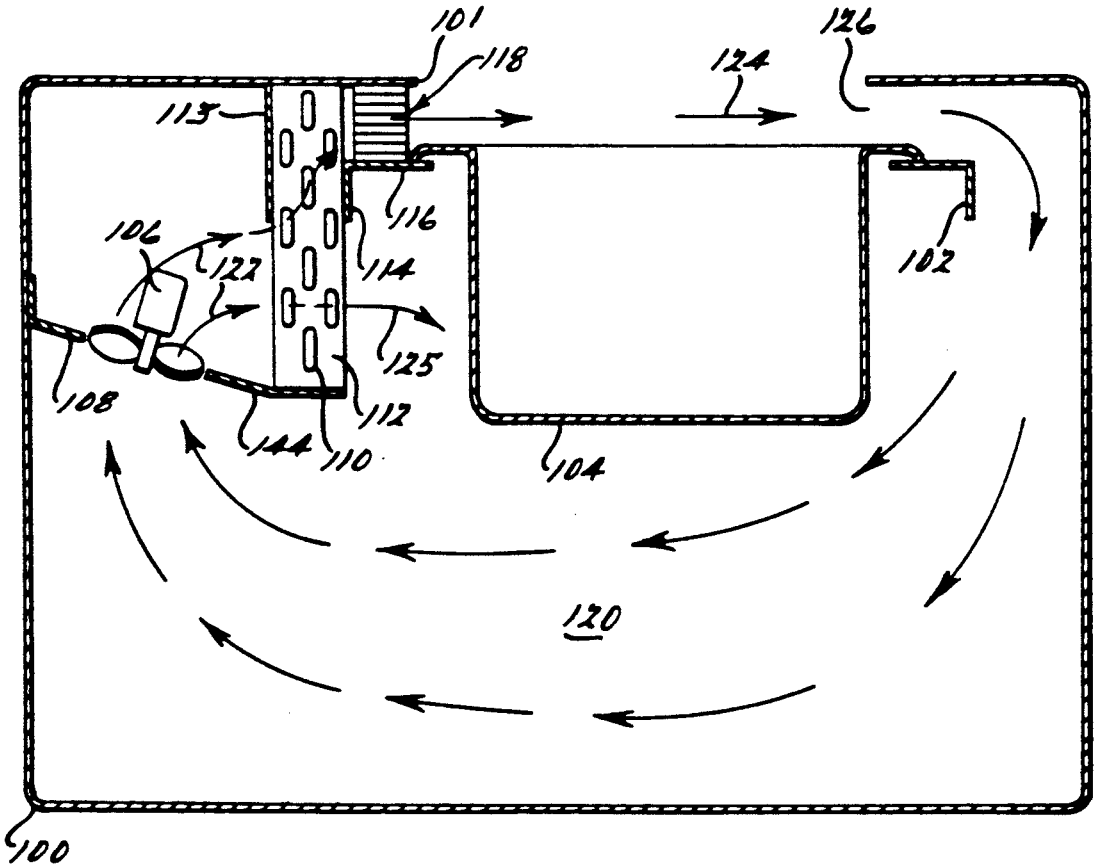
FIG. 3 is a view similar to FIG. 2 showing an alternative embodiment of the present invention.

An alternative embodiment of the present invention is shown in FIG. 3, and includes an outer housing 100 which is fully enclosed except for a partial top opening 101, a container holder 102, a food container 104, a f an 106, a fan baffle 108, an evaporator coil 110, heat transfer fins 112, a front baffle 113 a right angle plate which forms both a rear baffle 114 and a container holder 116, a lower support bracket 144 and a laminar air screen 118 constructed substantially similar to air screen 88. A storage volume 120 for refrigerated storage of other items is defined in the lower region of housing 100.

In operation of the alternative embodiment shown in FIG. 3, fan 106 generates an inlet air flow 122 which flows through evaporator coil 110 and fins 112, and is thereby cooled. Front and rear baffles 113 and 114 separate inlet air flow 122 into a first flow 124, and a second flow 125 which passes over the front, sides and bottoms of the food containers to cool same. First flow 124 passes through evaporator coil 110 and heat transfer fins 112 in a more tortuous flow path than that followed by second flow 125. First flow 124 is thereby cooled to a lower temperature than second flow 125. First flow then passes through laminar air screen 118 and flows across opening 101 and the top of food container 104, forming a laminar air screen across the food. First flow 124 then passes through a re-entry passage 126 and into housing 100. First and second flows flow through and refrigerate interior storage volume 120, and then combine and become inlet flow 122.

It should be understood that the preferred embodiment of the invention has been shown and described herein, and that various modifications of the preferred embodiment will become apparent to those skilled in the art after a study of the specification, drawings, and the following claims.

We claim:

1. A heat transfer device for cooling a fluid, comprising:

a) powered means for moving a fluid to create a fluid flow;

b) a heat exchanger; and c) direction controlling means for directing said flow through said heat exchanger to change the temperature thereof, said direction controlling means including baffle means for causing one portion of said fluid f low to follow a more tortuous path through said heat exchanger than the remainder of said fluid flow, whereby said one portion of said fluid flow undergoes a greater temperature change than said remainder of said fluid flow.

2. The heat transfer device as set forth in claim 1, wherein said heat exchanger includes a convoluted refrigerant evaporator coil.

3. The heat transfer device as set forth in claim 1, wherein said heat exchanger and direction controlling means are configured so as to force said one portion of said fluid flow to follow a more tortuous flow path through said heat exchanger than said remainder of said fluid.

4. The heat transfer device as set forth in claim 1, wherein said heat exchanger defines a surface area, said heat exchanger and direction controlling means being configured so as to force said one portion of said fluid flow to contact a greater surface area of said heat exchanger than said remainder of said fluid flow.

5. The heat transfer device as set forth in claim 2, wherein said heat exchanger further comprises a plurality of heat transfer fins.

6. The heat transfer device as set forth in claim 1, wherein said fluid is air.

7. The heat transfer device as set forth in claim 1, wherein said powered means is formed as a fan.

8. The heat transfer device as set forth in claim 5 wherein said fins define a cross-sectional area, said evaporator coil being substantially uniformly distributed throughout said cross-sectional area.

9. The heat transfer device as set forth in claim 1, which further comprises laminar flow means for reducing turbulence of said one portion of said fluid flow under steady flow conditions.

10. A refrigerated apparatus for containing and cooling foods, comprising:

a) a food container having an outer surface and an opening, said opening being open to air at an ambient temperature;

b) powered means for creating an air flow;

c) a heat exchanger for cooling said air flow; and d) direction controlling means for directing said flow through said heat exchanger to cool said flow, said direction controlling means including baffle means for causing one portion of said air flow to follow a more tortuous path through said heat exchanger than the remainder of said air f low, whereby said one portion of said air flow is cooled to a first temperature and said remainder of said air flow is cooled to a second temperature, said ambient temperature being greater than said second temperature, and said second temperature being greater than said first temperature.

11. The refrigerated apparatus as set forth in claim 10, wherein said heat exchanger includes a convoluted refrigerant evaporator coil.

12. The refrigerated apparatus as set forth in claim 10, wherein said heat exchanger and direction controlling means are configured so as to force said one portion of said air flow to follow a more tortuous path through said heat exchanger than said remainder of said air flow.

13. The refrigerated apparatus as set forth in claim 11, wherein said heat exchanger defines a surface area, said heat exchanger and direction controlling means being configured so as to force said one portion of said air flow to contact a greater surf ace area of said evaporator coil than said remainder of said air flow.

14. The refrigerated apparatus as set forth in claim 11, wherein said heat exchanger further comprises a plurality of heat transfer fins.

15. The refrigerated apparatus as set forth in claim 10, wherein said powered means is formed as a fan.

16. The refrigerated apparatus as set forth in claim 10, wherein said fins define a cross-sectional area, said evaporator coil being substantially uniformly distributed throughout said cross-sectional area.

17. The refrigerated apparatus as set forth in claim 10, which further comprises laminar flow means for reducing turbulence of said one portion of said air flow under steady flow conditions.

18. The refrigerated apparatus as set forth in claim 10, wherein said food container defines a volume, said refrigerated apparatus being operative to maintain said volume between 32° F. and 40° F.

19. The refrigerated apparatus as set forth in claim 10, wherein said one portion of said air flow is cooled to a temperature of 31° F.

20. The refrigerated apparatus as set forth in claim 10, wherein said remainder of said air flow is cooled to a temperature of 34° F.

21. The refrigerated apparatus as set forth in claim 10, wherein said food container has front, rear, bottom, and side surfaces, said one portion of said air flow flowing across said opening and along said rear surface, said remainder of said air flow flowing along said front, bottom, and side surfaces.

22. The refrigerated apparatus as set forth in claim 10, wherein said one portion of said air flow flows across said opening and said remainder of said air flow flows along said outer surface, so as to cool said container.

23. A refrigerated food preparation table, comprising:

a) a housing;

b) a food container supported within said housing and having an outer surface and an opening, said opening being open to air at an ambient temperature;

c) powered means for generating an inlet air flow;

d) a heat exchanger for cooling said air flow; and e) direction controlling means for directing said flow through said heat exchanger to cool said flow, said direction controlling means including baffle means for causing one portion of said flow to follow a more tortuous path through said heat exchanger than the remainder of said flow, whereby said one portion of said air flow is cooled to a first temperature and said remainder of said flow is cooled to a second temperature, said ambient temperature being greater than said second temperature, said second temperature being greater than said first temperature, said one portion of said flow flowing across said opening and said remainder of said flow flowing along said outer surface, said housing being configured so that said one portion and said remainder of said air flow combine subsequent to said flow across said opening and along said surface, and said housing being configured such that said air flow flows in a substantially cyclical path.

24. The table as set forth in claim 23, wherein said heat exchanger includes a convoluted refrigerant evaporator coil.

25. The table as set forth in claim 23, wherein said heat exchanger and direction controlling means are configured so as to force said one portion of said air f low to follow a more tortuous path through said heat exchanger than said remainder of said air flow.

26. The table as set forth in claim 23, wherein said heat exchanger defines a surface area, said heat exchanger and direction controlling means being configured so as to force said one portion of said air flow to contact a greater surface area of said evaporator coil than said remainder of said air flow.

27. The table as set forth in claim 24, wherein said heat exchanger further comprises a plurality of heat transfer fins.

28. The table as set forth in claim 23, wherein said powered means is formed as a fan.

29. The table as set forth in claim 23, wherein said fins define a cross-sectional area, said evaporator coil being substantially uniformly distributed throughout said cross-sectional area.

30. The table as set forth in claim 23, which further comprises laminar f low means for reducing turbulence of said one portion of said air flow under steady flow conditions.

31. The table as set forth in claim 23, wherein said food container defines a volume, said table being operative to maintain said volume between 32° F. and 40° F.

32. The table as set forth in claim 23, wherein said one portion of said air flow is cooled to a temperature of 31° F.

33. The table as set forth in claim 23, wherein said remainder of said air flow is cooled to a temperature of 34° F.

34. The table as set forth in claim 23, wherein said housing defines a storage volume, said combined air flowing through and thereby cooling said storage volume.

35. The table as set forth in claim 23, wherein said container has front, rear, bottom, and side surfaces, said one portion of said air flow flowing along and cooling said rear surface, said remainder of said air flow flowing along and cooling said front, bottom, and side surfaces.

36. The table as set forth in claim 23, wherein said baffle means is formed with at least one hole for allowing a small portion of said inlet air flow to leak through said hole.

37. A heat transfer device, comprising:

(a) a container having an opening, said opening being opened to air at an ambient temperature;

(b) powered means for creating an air flow;

(c) a heat exchanger for cooling said air flow;

(d) direction controlling means including baffle means for causing one portion of said air flow to follow a more tortuous path through said heat exchanger than the remainder of said air flow, whereby said one portion of said air flow is cooled to a first temperature and said remainder of said air flow is cooled to a second temperature, said ambient temperature being greater than said second temperature, and said second temperature being greater than said first temperature; and (e) flow means for reducing turbulence of said one portion of said air flow said flow means being constructed of a series of similar corrugated flow elements aligned with a flow path of said one portion of said air flow, and being formed so as to be placed in adjacent relationship to define a series of parallel flow channels said flow elements may be removed from said heat transfer device and separated for the purpose of cleaning.

* * * * *

UNITED STATES PATENT AND TRADEMARK OFFICE

CERTIFICATE OF CORRECTION

PATENT NO. : 5,282,367

DATED : February 1, 1994

INVENTOR(S) : Earl Moore; Thomas Frick; Wayne Smith; James Lyon

It is certified that error appears in the above-indentified patent and that said Letters Patent is hereby corrected as shown below:

TITLE PAGE

Abstract, line 6, "f low" should be -- flow --.

Abstract, line 10, "40" should be -- $40^{\circ}$ --.

Abstract, line 11, "32" should be -- $32^{\circ}$ --.

Column 2, line 36, "f lows" should be -- flows --.

Column 2, line 51, "f lows" should be -- flows --.

Column 3, line 2, "f lows" should be -- flows --.

Column 3, line 17, "f low" should be -- flow --.

Column 3, line 50, "f low" should be -- flow --.

Column 4, line 16, "f an" should be -- fan --.

Column 4, line 58, "f low" should be -- flow --.

Column 5, line 37, "f low" should be -- flow --.

Column 5, line 56, "surf ace" should be -- surface --.

Column 6, lines 55, 56, "f low" should be -- flow --.

Column 7, line 6, "f low" should be -- flow --.

Column 8, line 20, after "flow" (first occurrence) insert -- , --.

UNITED STATES PATENT AND TRADEMARK OFFICE

CERTIFICATE OF CORRECTION

PATENT NO. : 5,282,367

DATED : February 1, 1994

INVENTOR(S) : Earl Moore; Thomas Frick; Wayne Smith; James Lyon

It is certified that error appears in the above-indentified patent and that said Letters Patent is hereby corrected as shown below:

Column 8, lines 25, 26 and 27, delete "said flow elements may be removed from said heat transfer device and separated for the purpose of cleaning".

Signed and Sealed this

Twenty-third Day of August, 1994

*Attest:*

*Attesting Officer*

BRUCE LEHMAN

*Commissioner of Patents and Trademarks*